US005160197A

United States Patent [19]

Klose

[11] Patent Number: 5,160,197

[45] Date of Patent: Nov. 3, 1992

[54] SNAP COUPLING WITH TEMPERATURE READOUT FOR HAND SHOWER

[75] Inventor: Odo Klose, Wuppertal, Fed. Rep. of Germany

[73] Assignee: Friedrich Grohe Armaturenfabrik GmbH & Co., Hemer, Fed. Rep. of Germany

[21] Appl. No.: 760,863

[22] Filed: Sep. 16, 1991

[30] Foreign Application Priority Data

Sep. 17, 1990 [DE] Fed. Rep. of Germany ..... 4029419

[51] Int. Cl.[5] ..... G01K 13/02; G01K 1/14; A47K 3/22

[52] U.S. Cl. ..... 374/147; 374/148; 4/598; 4/605

[58] Field of Search ..... 374/147, 148; 239/71, 239/74, 283, 588; 285/46, 93; 403/27

[56] References Cited

U.S. PATENT DOCUMENTS

| | | | |
|---|---|---|---|
| 2,289,908 | 7/1942 | Gorton | 374/148 |
| 2,645,116 | 7/1953 | Baxter | 374/148 |
| 3,635,086 | 1/1972 | Beruck | 374/148 |
| 3,952,594 | 4/1976 | McMahan | 374/147 |
| 4,030,360 | 6/1977 | Fortune | 374/147 |
| 4,161,881 | 7/1979 | Raz | 374/147 |
| 5,076,709 | 12/1991 | Tognotti | 374/147 |

FOREIGN PATENT DOCUMENTS

| | | | |
|---|---|---|---|
| 0373581 | 6/1990 | European Pat. Off. . | |
| 0890872 | 9/1953 | Fed. Rep. of Germany | 374/148 |
| 2738316 | 3/1979 | Fed. Rep. of Germany . | |
| 2827847 | 4/1981 | Fed. Rep. of Germany . | |

*Primary Examiner*—William A. Cuchlinski, Jr.
*Assistant Examiner*—W. Morris Worth
*Attorney, Agent, or Firm*—Herbert Dubno; Andrew Wilford

[57] ABSTRACT

A hand shower having an upstream end is connected to a downstream end of a hose to receive water therefrom by a fitting having a snap coupling and a display. The snap coupling has a male part fixed on one of the ends, a female part fixed on the other of the ends and fittable over the male part, and a latch in the female part for releasably retaining the male part therein. The display is mounted on one of the parts and gives a readout of a parameter of the water flowing through the coupling.

11 Claims, 4 Drawing Sheets

SNAP COUPLING WITH TEMPERATURE READOUT FOR HAND SHOWER

FIELD OF THE INVENTION

The present invention relates to a snap coupling. More particularly this invention concerns such a coupling used at the end of a hose to connect a hand shower.

BACKGROUND OF THE INVENTION

German patent 2,827,847 of Hans Joachim Schmidt describes a coupling of the type usable to connect a hose end to a hand shower or the like. The coupling has a male portion with a protruding tubular sleeve and a female portion with a seat shaped to receive the sleeve and provided with a latch mechanism for holding the sleeve in place. Diametrally opposite buttons on the female portion can be depressed to release the latch and allow the two parts to be separated. Such an arrangement makes it fairly simple to switch shower heads, for instance to install one with a different spray pattern.

U.S. Pat. No. 4,030,360 describes a fitting which can be installed immediately upstream of a shower or the like to provide a direct readout of water temperature. This gauge has a female threaded socket on one side and a male threaded nipple on the other so that it can be placed, for instance, immediately upstream of a shower head. Mounting such a bulky device on a hand shower, however, is out of the question, especially combined with the extra bulk of a snap coupling.

OBJECTS OF THE INVENTION

It is therefore an object of the present invention to provide an improved snap coupling for a hand shower or the like.

Another object is the provision of such an improved snap coupling for a hand shower or the like which overcomes the above-given disadvantages, that is which can provide a readout of some parameter—pressure, temperature, flow rate—of the water being fed to the shower but that the adds insignificantly to the bulk of the hand shower.

SUMMARY OF THE INVENTION

A hand shower having an upstream end is connected to a downstream end of a hose to receive water therefrom by a fitting having a snap coupling and a display. The snap coupling has a male part fixed on one of the ends, a female part fixed on the other of the ends and fittable over the male part, and a latch in the female part for releasably retaining the male part therein. The display is mounted on one of the parts and gives a readout of a parameter of the water flowing through the coupling.

Thus according to the invention the display, which can be made very small with today's subminiature electronics, is incorporated right in the snap coupling. This makes it a very convenient retrofit and is of particular interest with a hand shower.

According to the invention the display is mounted on the male part and the female part is integral with the hand shower. The display includes a temperature sensor so that it can show temperature, normally digitally.

In accordance with further features of this invention the male part is formed with a recess on a side opposite the display, has therein a battery for powering the display, and is provided with a watertight cover for closing the recess over the battery. In addition the male part is formed with a central flow tube and with an annular compartment around this tube and the recess opens into this compartment. Conductors extend through the compartment between the battery and the display and the temperature sensor projects through the tube into the compartment. It is possible for the male part to be formed of two sections joined together at a plane crossing the compartment.

In accordance with another system according to the invention the male part is formed with a longitudinal passage for the throughflow of water and a transverse passage traversing the longitudinal passage and forming the recess. The display is mounted on an insert matingly engageable in and through the transverse recess. The transverse passage is of generally square section and the insert has an end of complementary square section and a central portion of substantially smaller size in the longitudinal passage.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

DESCRIPTION

Figure 1:
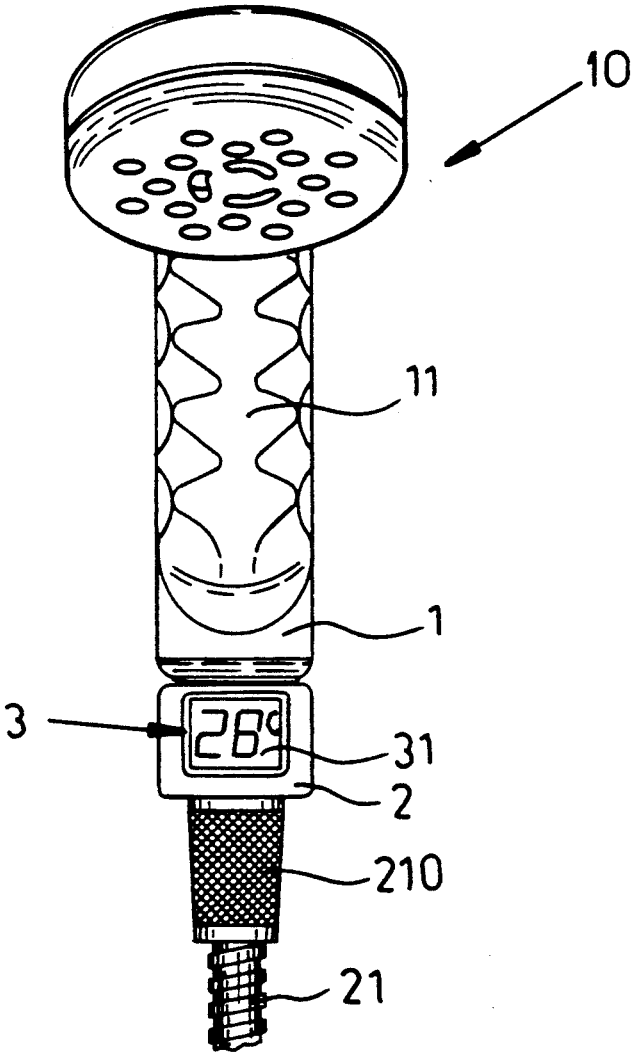
FIG. 1 is a front elevational view of the hand shower according to the invention.
Figure 2:
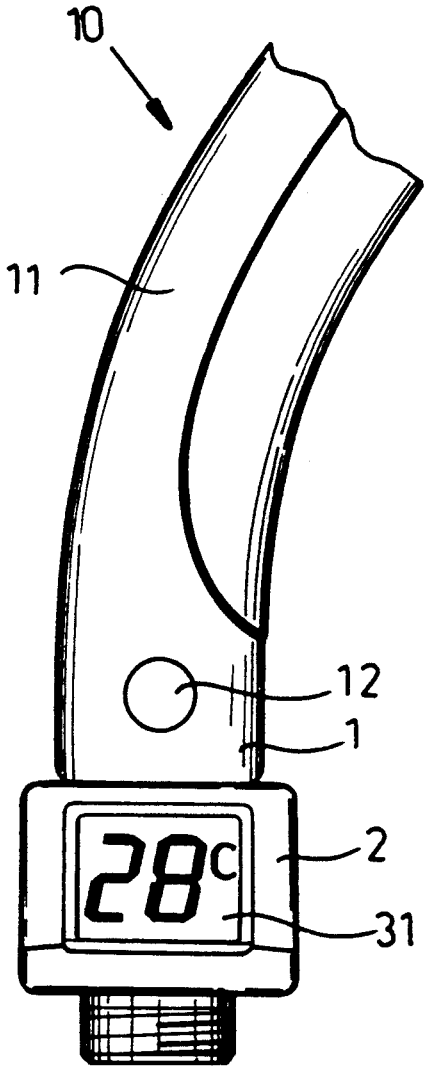
FIG. 2 is a large-scale view of a detail of FIG. 1 with the shower turned 90°.

As seen in FIGS. 1 and 2 a hand shower 10 according to this invention has a handle 11 integrally formed with a female snap-coupling part 1 that fits on a male coupling part 2 provided with a temperature indicator 3 having an LCD or LED display 31. The male coupling part 2 itself is mounted on a sleeve 210 carried at the outer end of a hose 21 and adapted to fit into a wall bracket. The handle 11 has one or two latch-actuating pushbuttons 12 that can be depressed to separate the shower 10 from the hose 21 in the manner described in the above-cited German patent.

Figure 3:
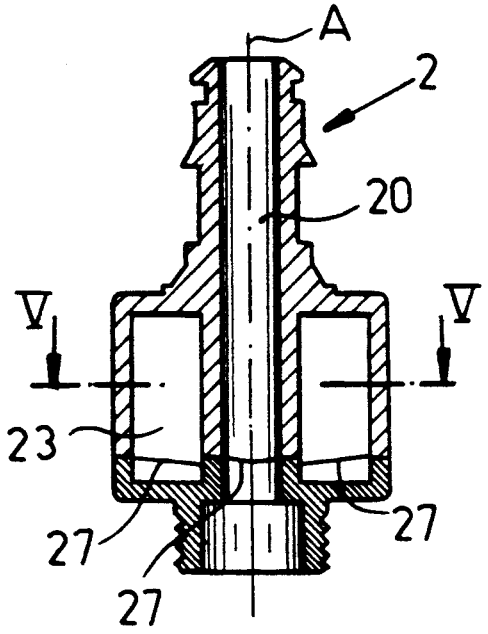
FIGS. 3 and 4 are longitudinal axial sections through the male part of the coupling taken along 90° offset planes.
Figure 4:
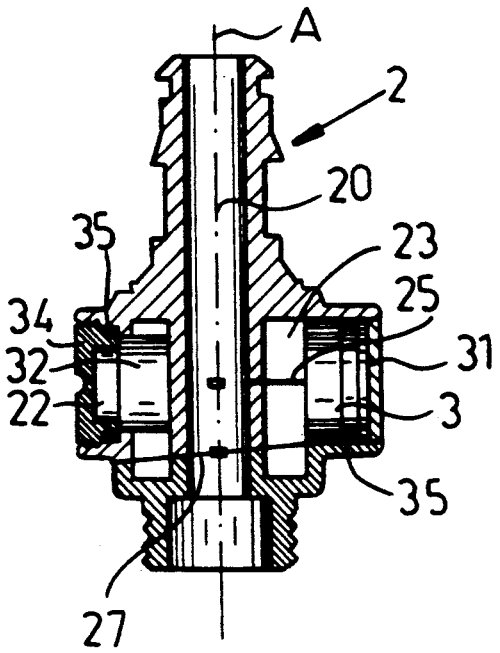
Figure 5:
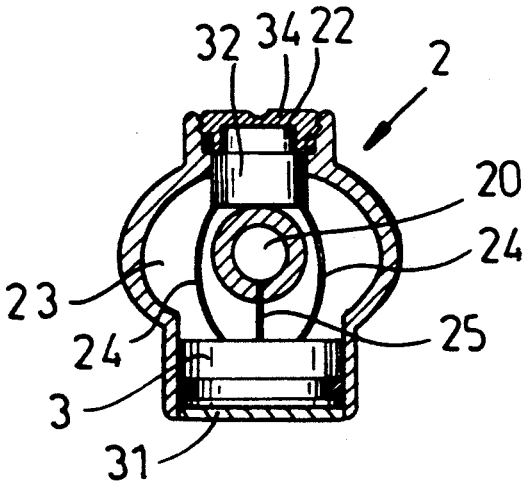
FIG. 5 is a section taken along line V—V of FIG. 3.

FIGS. 3 through 5 show how the male coupling part 2 has a central passage or flow tube 20 centered on an axis A and is formed of two parts joined axially at a joint 27 extending roughly perpendicular to the axis A. This part 2 forms an annular compartment 23 around the central tube 20 that opens at one side at a recess 22 housing a small battery 32 held in place by a plug 32 34. On its other side it houses the electronics of the indicator 3 that are connected via wires 24 in the compartment 23 to the battery 32 and that has a sensor wire 25 that extends into the tube 20 to detect the temperature of the water therein. The plug 34 screws in and has a seal ring 35 to make the joint water-tight, and similarly the indicator 3 has a seal ring 35 to keep water out of the electronics.

Figure 6:
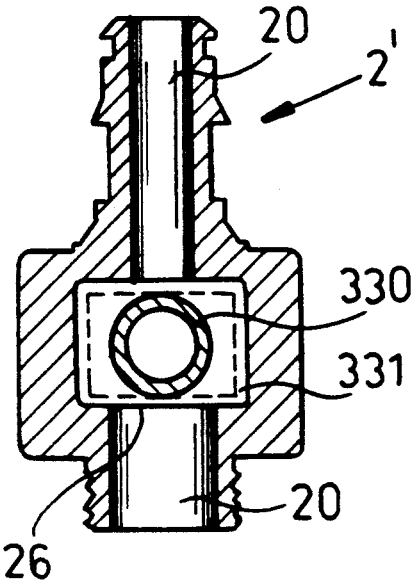
FIGS. 6 and 7 are views like FIGS. 3 and 4 of a variant on the system of this invention.
Figure 7:
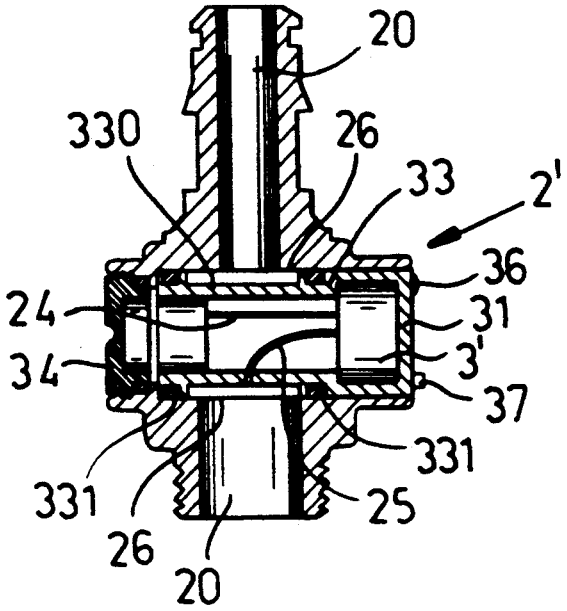
Figure 8:
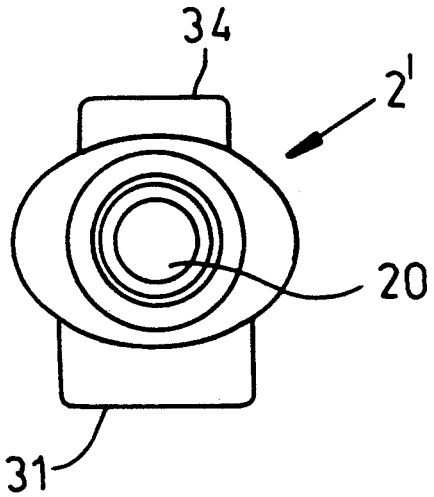
FIG. 8 is a top view of the coupling part of FIGS. 6 and 7.

In FIGS. 6 through 8 the part 2' has a square-section passage 26 into which fits a casing 33 holding the display 31 and its electronics 3'. This casing 33 has an outer end portion 331 of a square shape complementary to the hole 26 but is centrally formed as a small-diameter cylindrical tube 330 around which the water flows and seal rings 331 are provided to each side of the passage 20 to prevent leakage. The casing 33 is held in place by a set screw or is permanently glued in. It can have a small solar cell 36 to power the assembly and a small button 37 can be provided as an on-off switch to operate it.

I claim:

1. In combination with a hand shower having an upstream end; and a hose having a downstream end adapted to be connected to the shower upstream end to feed water to same; a fitting comprising:

a snap coupling including a male part fixed on one of the ends;

a female part fixed on the other of the ends and fittable over the male part; and latch means in the female part for releasably retaining the male part therein;

means including a display on one of parts for giving a readout of a parameter of the water flowing through the coupling, the one part being formed with a recess on a side opposite the display;

a battery in the recess for powering the display; and a watertight cover over the recess for closing the recess over the battery.

2. The hand-shower fitting defined in claim 1 wherein the display is mounted on the male part.

3. The hand-shower fitting defined in claim 2 wherein the female part is integral with the hand shower.

4. The hand-shower fitting defined in claim 3 wherein the means includes a temperature sensor and the display shows temperature.

5. The hand-shower fitting defined in claim 4 wherein the display provides a digital readout of temperature.

6. The hand-shower fitting defined in claim 1 wherein the male part is formed with a central flow tube and with an annular compartment around this tube, the recess being formed in the male part and opening into this compartment, the means including conductors extending through the compartment between the battery and the display and a temperature sensor projecting through the tube into the compartment.

7. The hand-shower fitting defined in claim 6 wherein the male part is formed of two sections joined together at a plane crossing the compartment.

8. The hand-shower fitting defined in claim 1 wherein the male part is formed with a longitudinal passage for the throughflow of water and a transverse passage traversing the longitudinal passage and forming the recess, the means including an insert matingly engageable in and through the transverse recess.

9. The hand-shower fitting defined in claim 8 wherein the transverse passage is of generally square section and the insert has an end of complementary square section and a central portion of substantially smaller size in the longitudinal passage.

10. The hand-shower fitting defined in claim 1, further comprising a switch for turning the display on and off.

11. The hand-shower fitting defined in claim 1, further comprising a solar cell for powering the display.

* * * * *

UNITED STATES PATENT AND TRADEMARK OFFICE

CERTIFICATE OF CORRECTION

PATENT NO. : 5,160,197

DATED : NOVEMBER 3, 1992

INVENTOR(S) : ODO KLOSE

It is certified that error appears in the above-indentified patent and that said Letters Patent is hereby corrected as shown below:

On the title page, item [73], Assignee should read:
—FRIEDRICH GROHE AKTIENGESELLSCHAFT—

Signed and Sealed this

Twenty-fourth Day of September, 1996

*Attest:*

Bruce Lehman

BRUCE LEHMAN

*Attesting Officer*

*Commissioner of Patents and Trademarks*